United States Patent [19]

Pouderoux

[11] 4,120,348

[45] Oct. 17, 1978

[54] HEAT EXCHANGER HAVING A PLURALITY OF MODULES CONNECTED IN PARALLEL

[75] Inventor: Pierre Pouderoux, Meudon, France

[73] Assignee: Stein Industrie S.A., Valizy-Villacoublay, France

[21] Appl. No.: 749,260

[22] Filed: Dec. 10, 1976

[30] Foreign Application Priority Data

Dec. 18, 1975 [FR] France ..... 75 38834

[51] Int. Cl.[2] ..... F28F 7/00

[52] U.S. Cl. ..... 165/81; 176/40; 176/65; 165/143; 165/158

[58] Field of Search ..... 165/143, 145; 176/65, 176/64; 122/32, 34

[56] References Cited

U.S. PATENT DOCUMENTS

| | | | |
|---|---|---|---|
| 3,253,996 | 5/1966 | Bond, Jr. et al. | 176/65 |
| 3,956,063 | 5/1976 | Johnson et al. | 176/65 |
| 3,966,549 | 6/1976 | Michel | 176/65 |

FOREIGN PATENT DOCUMENTS

| | | | |
|---|---|---|---|
| 837,031 | 6/1960 | United Kingdom | 176/65 |

*Primary Examiner*—Charles J. Myhre
*Assistant Examiner*—Theophil W. Streule, Jr.
*Attorney, Agent, or Firm*—Haseltine, Lake & Waters

[57] ABSTRACT

A heat exchanger has a plurality of modules in parallel, each module has a nest of tubes for circulating first fluid to be heated, vaporized and/or superheated. The nest is disposed between two perforated discs in a casing for the flow of a second fluid, inlet collectors for the second fluid at the top part of the modules connected to a common feed cylinder and outlet collectors for the second fluid at the bottom part of the modules connected to a common discharge cylinder. The axes of the modules are set at a constant angle on a circle having as its axis, the vertical axis common to the cylinders and the modules are connected by short straight collectors to the common feed cylinders, while the discharge cylinder is connected by generally U-shaped collectors which are sufficiently resilient to allow for expansion of the module in the event of accidental reaction between the sodium and the water. Application to nuclear power stations using a sodium-cooled rapid neutron nuclear reactor.

2 Claims, 2 Drawing Figures

HEAT EXCHANGER HAVING A PLURALITY OF MODULES CONNECTED IN PARALLEL

The present invention relates to a heat exchanger having a plurality of modules connected in parallel.

It relates in particular to heat exchangers in which the modules are vertically oriented and generally elongate structures each having a nest of tubes for conveying a first fluid to be heated, vaporized and/or superheated. The nest of tubes is disposed between two perforated discs arranged in a jacket for conveying a second fluid to be cooled. Inlets for the second fluid are disposed near the top part of the modules and are connected to a common feed vessel and outlets for the second fluid are disposed near the lower part of the modules and are connected to a common discharge sump.

Heat exchangers formed by such modules are described in particular in the Applicant's French patent No. 2,134,067 of Mar. 6, 1970. They are suitable in particular for heat exchange between a molten alkaline metal heated in a rapid neutron nuclear reactor and water which is turned into superheated steam for feeding a nuclear power station. These heat exchangers are subjected to very great differences in temperature between their hot end and their cold end, provoking thermal expansions and stresses on their inlet and outlet conduits or collectors.

Preferred embodiments of the present invention enable these stresses to be reduced.

The present invention provides a heat exchanger comprising a plurality of heat exchanger modules, a common feed vessel for receiving a hot molten alkaline metal for distribution to the modules and a common sump for recycling cooled molten alkaline metal from the modules, the feed vessel being disposed above the sump and the heat exchanger modules being generally vertically oriented elongate members disposed around said feed vessel and sump, wherein the feed vessel is connected to the heat exchanger modules by short straight collectors and the sump is connected to the modules by longer generally U-shaped collectors having their respective inputs and outputs at different levels whereby the sump collectors have sufficient resilience to allow for expansion of a heat exchanger module in the event of accidental reaction between the alkaline metal and the cooling fluid of the heat exchanger.

Preferably the modules are supported by means of support structures 29 which retain the modules at substantially the same level as the level at which the hot molten metal enters the modules.

A description is given hereinbelow of a water-sodium heat exchanger having four modules for a nuclear power station using a rapid neutron nuclear reactor. The description is of a particular embodiment and is given by way of example with reference to the accompanying drawings in which.

Figure 1:
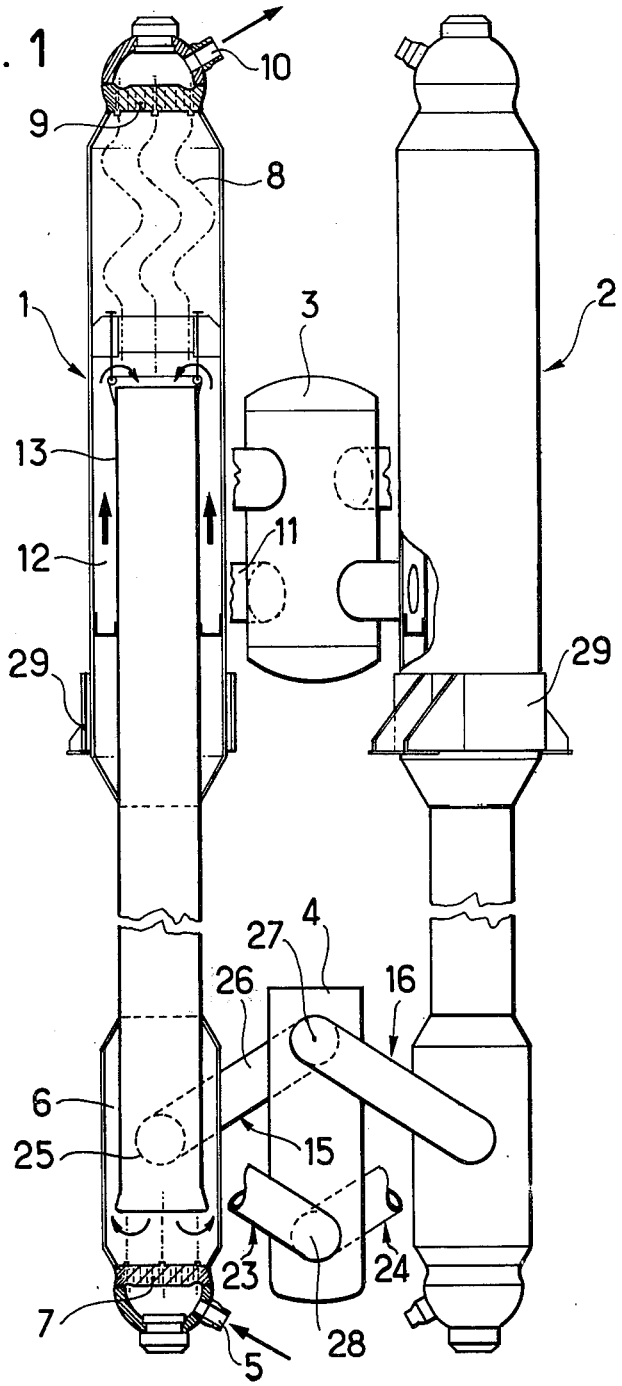
FIG. 1 shows two modules of the heat exchanger, one in vertical cross-section and the other is elevation, as well as the liquid sodium feed and discharge cylinders.

FIG. 1 shows a first heat exchanger module 1 in cross-section has a second module 2 in elevation. The modules are connected to a feed cylinder 3 for distributing liquid sodium coming from the nuclear reactor and to a discharge cylinder 4 for recycling the sodium. The other two modules are not shown, but the modules are disposed symmetrically at 90° intervals around a circle centred on the cylinders 3 and 4. The water to be heated to superheated steam is introduced into the bottom of the module 1 through tubing 5, then passes into a nest of tubes 6 connected to a perforated disc 7. At the hot end of the heat exchanger module, the nest of tubes 6 forms an expansion bend 8, e.g. of the type described in the applicant's published French patent application No. 2,218,528 of Feb. 19, 1973 and then passes through a further perforated disc 9. The superheated steam is supplied to a load via tubing 10. The liquid sodium fed vessel is in the form of a cylinder 3 connected by a straight pipe 11 to an annular space 12 round a casing 13 surrounding the nest of tubes 6. The liquid sodium rises into the annular space 12. passing round stabilization baffle plates, not shown, up to the top end of the casing 13, then flows into the casing 13 round the steam tubes. In a known way, the liquid sodium level above the edge of the casing 13 is kept constant and is surmounted by an argon atmosphere which protects the perforated disc 9 from contact with very hot sodium and makes it possible to damp any pressure peaks occuring in the event of a leak in the nest of tubes 6, provoking direct contact between the hot sodium and water or steam. At the bottom end of the module, an outer jacket enables the cooled sodium to flow towards the discharge sump, also in the form of a cylinder 4 through a collector 15. The module 2 is connected to the discharge cylinder 4 by an analogous collector 16.

Figure 2:
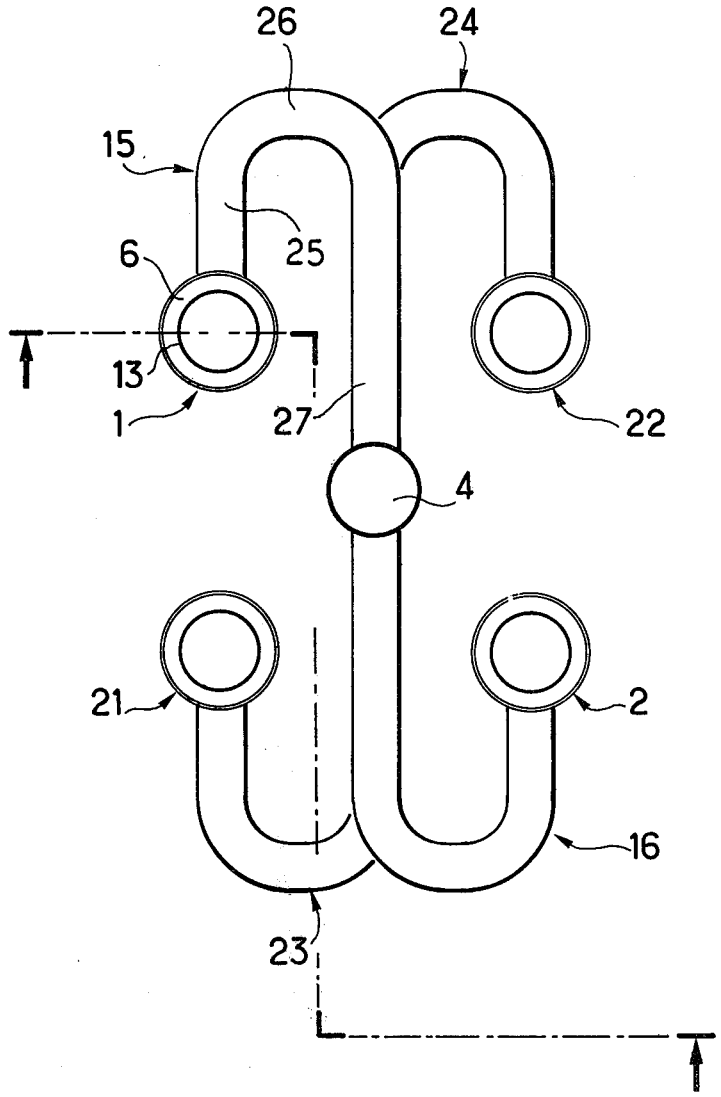
FIG. 2 is a horizontal cross-section taken above the outlet collectors and showing the four modules and the discharge cylinder.

The disposition and the shape of the outlet collectors can be seen more easily in FIG. 2. This figure shows in cross-section the modules 1, 2, 21 and 22 and the discharge cylinder 4. The collector 15 has a straight part 25 in the vicinity of the module 1, a curved part 26 and a straight part 27 connecting it to the discharge cylinder 4. It therefore assumes a generally U-shape (without both limbs of the U necessarily having the same length) and is disposed in an oblique plane (i.e. the axes of the modules and of the discharge cylinder 4 are vertical as shown in FIG. 1). The collector 16 and further collectors 23 and 24 are similar to one another, except that the collectors 23 and 24 are connected to the discharge cylinder 4 at a level lower than that of their connections to their respective modules 21 and 22 (the connection orifice to the collector 23 to the discharge cylinder 4 being shown at 28 in FIG. 1).

Although the structure of the heat exchanger which has just been described with reference to the drawing may appear preferable, it will be understood that various modifications can be made thereto without going beyond the scope of the invention, it being possibe to replace some of its elements by others which would fulfill the same technical function therein.

In particular, the number of modules of the heat exchanger can be less or greater than four, in particular as a function of the total quantity of heat to be transmitted. Each module can have more than on inlet collector for bringing the fluid from the feed cylinder 3 and more than one collector going towards the common discharge cylinder. Where due to design considerations, the heat exchanger height is too large for practical construction purposes, the heat exchanger can be subdivided into two parts with corresponding conduit connections for molten alkaline metal and steam. A first heat exchanger is in a relatively low temperature zone ensuring only the heating and boiling of the water and a second heat exchanger is in a higher temperature zone, ensuring the superheating of the steam.

What we claim is:

1. A heat exchanger for heat exchange between a molten alkaline metal and water to be vaporized and superheated, employing a plurality of heat exchanger modules; a common feed vessel for receiving said molten alkaline metal for distribution to said modules; a common sump for recycling cooled molten alkaline metal metal from said modules; said feed vessel being disposed above said sump and said heat exchanger modules being formed of generally vertically oriented elongated members disposed around said feed vessel and sump, wherein: said feed vessel being connected to said heat exchanger modules by short straight collectors, and said sump being connected to said modules by generally U-shaped collectors having respective inputs and outputs at different levels whereby said sump collectors being formed to have sufficient resilience for expansion of a heat exchanger module in the event of accidental reaction between said alkaline metal and cooling fluid of said heat exchanger.

2. A heat exchanger according to claim 1, wherein: said modules being supported by means of support structures retaining said modules at substantially the same level as the level at which the hot molten enters said modules.

* * * * *